US010159383B2

(12) United States Patent
Pelfrey

(10) Patent No.: US 10,159,383 B2
(45) Date of Patent: Dec. 25, 2018

(54) CUSTOMIZABLE DISPENSER HAVING PLUG-IN CIRCUIT MODULES

(71) Applicant: GOJO Industries, Inc., Akron, OH (US)

(72) Inventor: Keith Allen Pelfrey, Wadsworth, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 15/341,126

(22) Filed: Nov. 2, 2016

(65) Prior Publication Data

US 2017/0119219 A1 May 4, 2017

Related U.S. Application Data

(60) Provisional application No. 62/249,495, filed on Nov. 2, 2015.

(51) Int. Cl.
*A47K 5/12* (2006.01)

(52) U.S. Cl.
CPC ..... *A47K 5/1217* (2013.01); *A47K 5/12* (2013.01); *A47K 5/1208* (2013.01)

(58) Field of Classification Search
CPC ..... A47K 5/1217; B65D 83/26
See application file for complete search history.

(56) References Cited

U.S. PATENT DOCUMENTS

| | | | | |
|---|---|---|---|---|
| 8,646,656 | B2 * | 2/2014 | Johnson | A47K 5/1217 222/52 |
| 2010/0134296 | A1 * | 6/2010 | Hwang | A47K 5/1217 340/573.1 |
| 2012/0112914 | A1 * | 5/2012 | Wegelin | A47K 5/1217 340/573.1 |
| 2013/0334248 | A1 * | 12/2013 | Iseri | A47K 5/1211 222/82 |
| 2015/0207275 | A1 * | 7/2015 | Wegelin | F16M 13/02 248/542 |
| 2016/0274596 | A1 * | 9/2016 | Buell | G06F 19/327 |

* cited by examiner

*Primary Examiner* — Donnell Long
(74) *Attorney, Agent, or Firm* — Calfee, Halter & Griswold LLP

(57) ABSTRACT

A product dispenser may be customized by incorporating a backplane having multiple different electrical contacts points and multiple different connectors for receiving one or more dispenser plug-in circuit modules, where each plug-in circuit module has mating electrical contacts and connector members. Different dispenser plug-in circuit modules may be easily installed, i.e. plugged-in, during assembly and/or during installation of the product dispenser to change the operating features of a particular dispenser.

20 Claims, 9 Drawing Sheets

CUSTOMIZABLE DISPENSER HAVING PLUG-IN CIRCUIT MODULES

FIELD OF THE INVENTION

This application claims priority to, and the benefits of, U.S. Provisional Application Ser. No. 62/249,495, filed on Nov. 2, 2015 and titled PLUG-IN POWER BUS FOR PRODUCT DISPENSER, which is incorporated herein by reference in its entirety.

FIELD OF THE INVENTION

The current invention relates generally to product dispensers that can be easily customized, and in particular to product dispensers that can be selectively configured to incorporate one or more plug-in modules.

BACKGROUND OF THE INVENTION

Product dispensers are used to dispense a wide range of hand care products in a plethora of different industrial, commercial and other settings. For example, hospitals and healthcare facilities install product dispensers to disperse soap, lotion or hand sanitizers from wall mounted or counter mounted dispensers. End-users activate the product dispensers either manually by depressing a push bar or automatically by coming into proximity with a sensor.

With the advancement of technology, product dispensers are becoming more sophisticated. Some product dispensers incorporate electronic circuitry and/or sensors that monitor pump activation. Other product dispensers include wireless communication circuitry for transmitting data about operation of the dispenser to a remote location. Still other product dispensers incorporate sensors that detect the size of the end-user (or end user's hand) for determining proper dosage. It may be necessary, when used in a particular setting, to install a dispenser having one or more of these or other advanced technology features.

However, not every application site requires the same combination of product dispenser features. Accordingly, dispensers may include controllers that container hardware and or software to perform a number of functions. But, constructing a product dispenser with all of the hardware and software to provide such features increases the cost of the dispensers and the features may not ever be used.

SUMMARY OF THE INVENTION

In one exemplary embodiment, a product dispenser includes a housing configured to support one or more components of the product dispenser, a replaceable product reservoir supported by the housing, a pump having a product inlet fluidly connected to the product reservoir where the pump has an outlet for dispensing associated product, a pump actuator operatively coupled to the pump, a source of electrical power received by the housing where the source of electrical power includes first and second terminals that may have opposite polarity and a backplane electrically communicated to the source of electrical power for providing electrical power to a plurality of plug-in circuit modules. The backplane may include multiple sets of electrically conductive contact terminals, where each set of contact terminals is operable to electrically connect to one of the plurality of plug-in circuit modules when the circuit module is plugged in to the backplane, and may include multiple connector receiving members each juxtaposed to a corresponding set of contact terminals, where each connector receiving member is adapted to hold one of the plug-in circuit modules fixedly in place thereby securing the plug-in circuit module to the backplane.

In another exemplary embodiment, the source of electrical power includes a battery mounted to the replaceable product reservoir wherein the replaceable product reservoir includes electrical contact members for electrically connecting to the backplane when the replaceable product reservoir is installed into the product dispenser.

In another exemplary embodiment, the source of electrical power is one or more batteries received by the housing of the product dispenser.

In yet another exemplary embodiment, the backplane is comprised of: a substrate and electrical conductors received within a substrate.

In another exemplary embodiment, the substrate is affixed to the housing of the product dispenser.

And even yet another exemplary embodiment, the backplane includes electrical conductors that are integrally formed into the housing or walls of the product dispenser.

In still yet another exemplary embodiment, the product dispenser includes a controller, also known as a dispenser control unit, the controls one or more operations of the product dispenser and wherein the dispenser control unit powered by the source of electrical power, which may be batteries.

And even yet another exemplary embodiment, the backplane includes separate conductors that each exclusively conduct either power or data between the controller and the plug-in circuit modules.

Another aspect of an exemplary embodiment further includes a sensor capable of detecting the presence of a user hand for activating the product dispenser, the sensor having an output signal operatively communicated with the dispenser control unit and wherein the pump actuator is motor powered by the source of electrical power and activated by the dispenser control unit.

In another exemplary embodiment, the plug-in circuit modules include an electrical circuit for processing information about the dispenser, wherein the plug-in circuit modules includes first and second electrically conductive contacts arranged for connection to one of the multiple sets of contact terminals, whereby connecting the contact terminals electrically connects the electrical circuit of the dispenser module to the backplane.

In another exemplary embodiment, backplane includes a communication buss for placing one or more modules in communication with a dispenser processor.

In another exemplary embodiment of methodology of custom assembly of a product dispenser includes the steps of: providing a dispenser housing having walls configured to support one or more components of the product dispenser; installing into the dispenser housing: a product reservoir, a pump having an inlet operatively connected to the product reservoir, a pump actuator operatively connected to the pump and a source of electrical power having first and second terminals; providing a backplane having multiple sets of electrically conductive contact terminals, wherein each set of contact terminals is respectively electrically connected to the first and second terminals of the source of electrical power; installing the backplane into the dispenser; providing a plurality of dispenser modules each having an electrical circuit for processing information related to the operation of the product dispenser; and, optionally installing one or more dispenser modules into the backplane.

In one aspect of another exemplary embodiment, the method further includes the steps of: providing a first backplane installed into a first dispenser housing, installing a first dispenser module into the first backplane, providing a second backplane installed into a second dispenser housing and installing a second substantially different dispenser module into the second backplane.

In yet another aspect of an exemplary embodiment, the method further includes the step of installing a dispenser module substantially identical to the first dispenser module into the second backplane.

DETAILED DESCRIPTION

A product dispensing system (illustrated in FIG. 1) dispenses a measured amount of product. In one exemplary instance, the product dispenser, shown generally at 10, dispenses hand care products such as, for example, soap, lotion or sanitizers, although other products, granular or liquid, may similarly be dispensed from the product dispenser 10.

Figure 1:
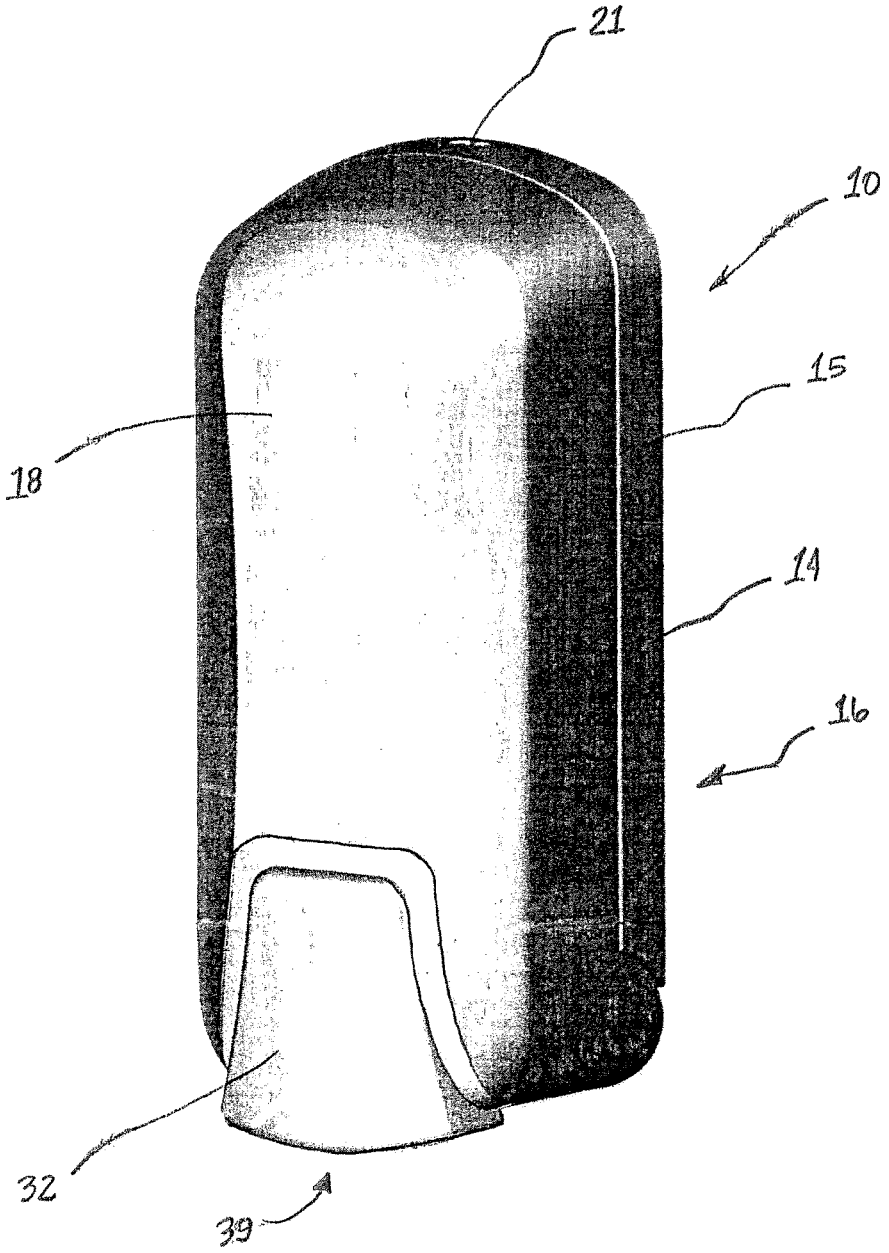
FIG. 1 depicts an exemplary embodiment of a manually activated product dispensing system having a push bar.
Figure 2:
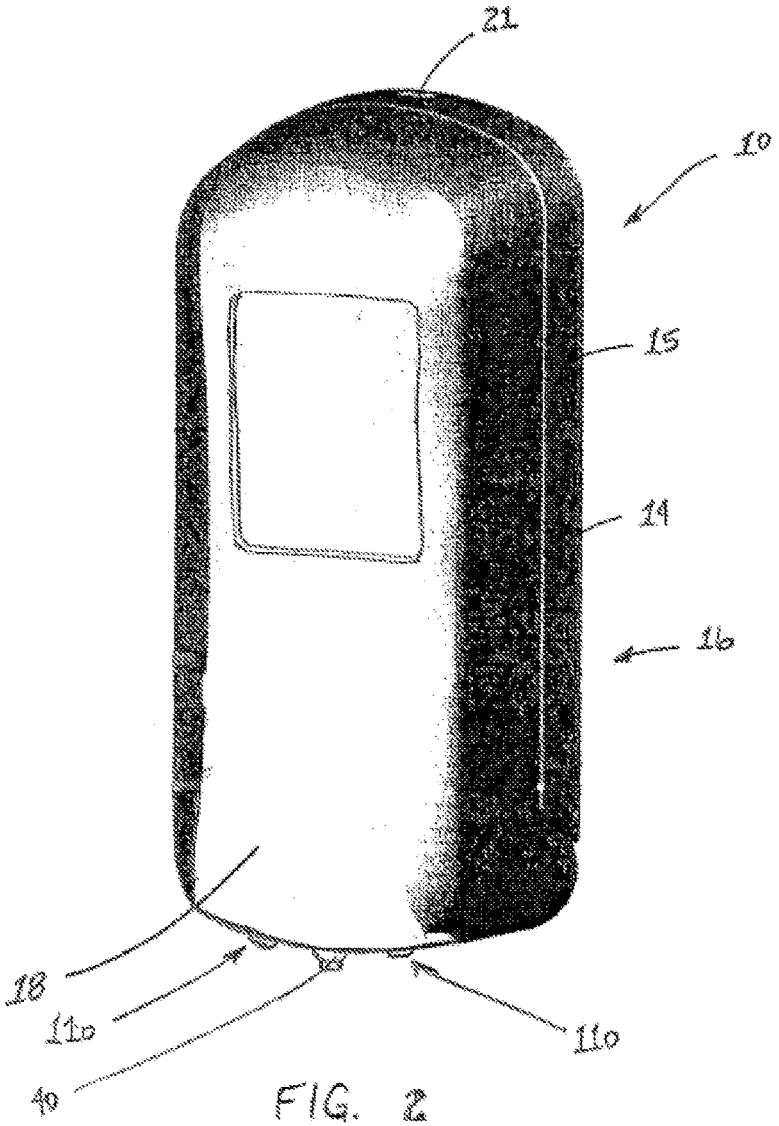
FIG. 2 depicts an exemplary embodiment of an automatically activated product dispensing system having an activation sensor.
Figure 3:
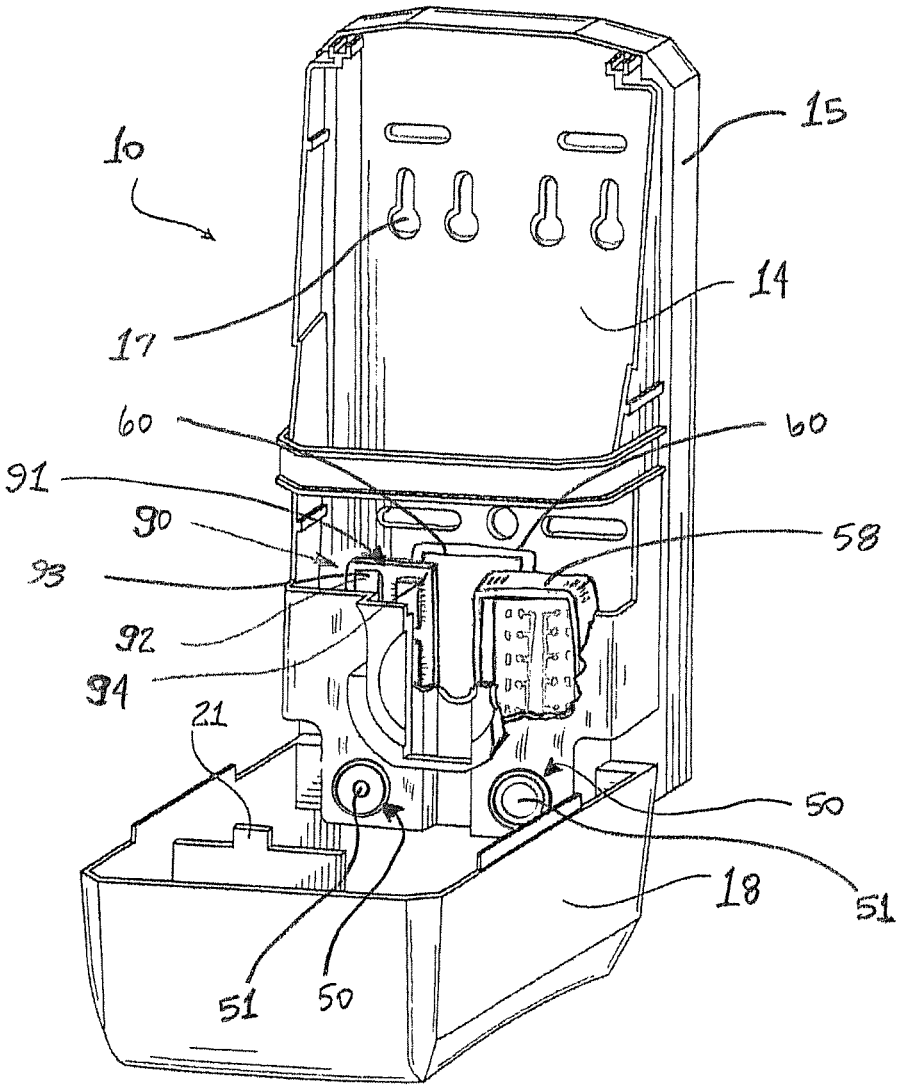
FIG. 3 shows an exemplary embodiment of a partial cutaway view of a product dispenser having a source of power and a backplane received by the product dispenser.

As illustrated in the exemplary embodiments shown in FIGS. 1 through 3, the product dispenser 10 includes a housing 14 also referred to herein interchangeably as a base 14. The housing 14 or base 14 is made of one or more walls 15 constructed to support the components of the product dispenser 10. Plastic may be used for cost-effective manufacturing of the base 14, as well as other components of the system. A product reservoir 26, which may be a replaceable product reservoir 26, is mounted to the base 14 and includes a pump 29 for dispensing product in a manner known in the art. At a rear side 16 of the base 14, a mounting bracket or mounting holes 17 (shown in FIG. 3) are included for attaching the dispenser 10 to a wall, a table, a dispenser stand or other supporting structure, not shown in the figures.

A dispenser cover 18 is provided that is connected to the base 14. The cover 18 can be pivotally connected to the base 14 via hinge 19 and secured in place by way of a latch 21 or other closure mechanism. In one instance, the base 14 and cover 18 close together to form an enclosure that prevents immediate access to the product dispenser 10. The latch 21 may come equipped with a lock and key to restrict access to authorized personnel.

Figure 2A:
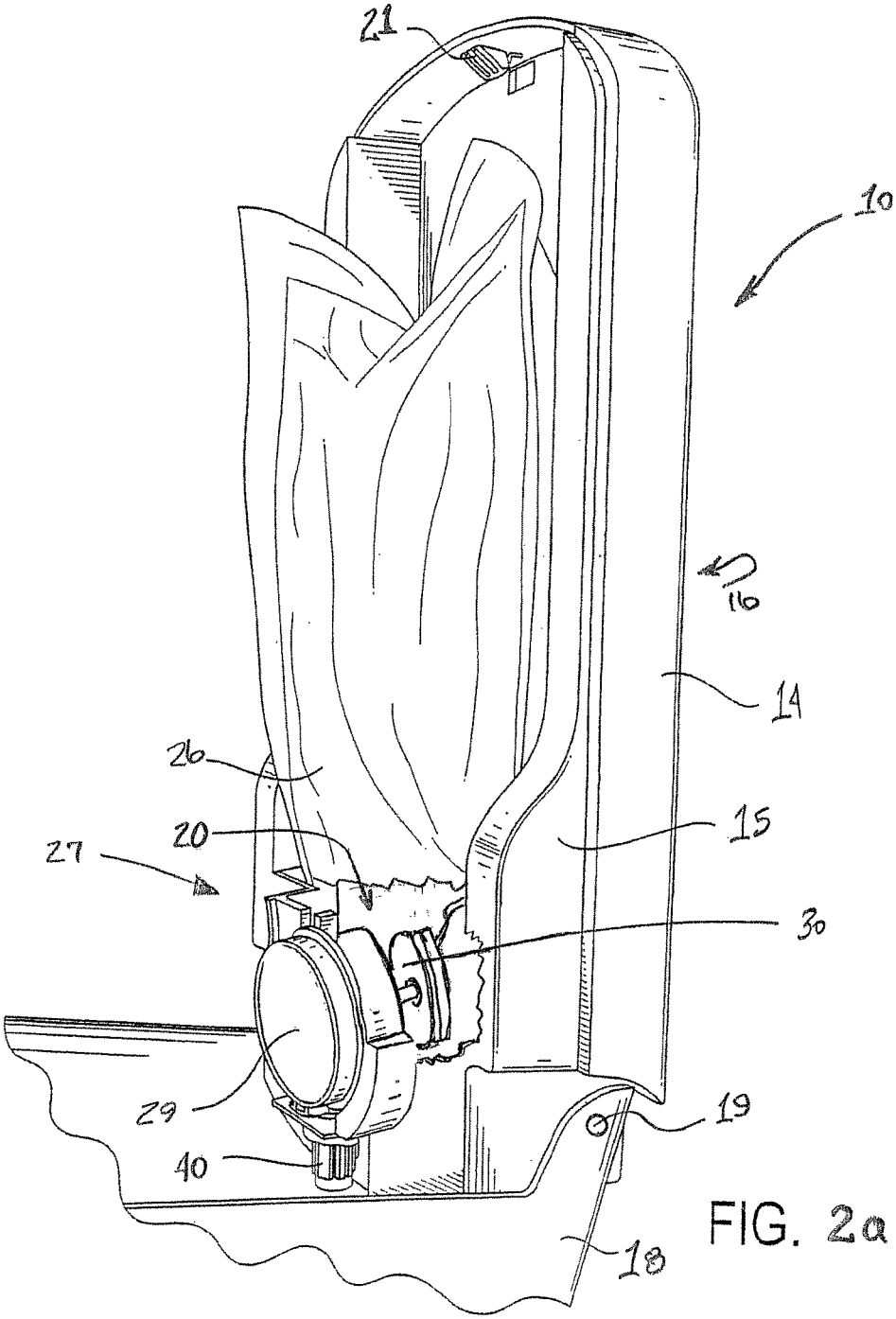
FIG. 2*a* depicts a partial cutaway view of an exemplary embodiment of an automatically activated product dispensing system showing an internal region of the product dispenser.

The base 14 is designed to securely receive the product reservoir 26. The walls 15 of the base 14 may be constructed to form a concave region 20 at one end of the product dispenser 10. The walls 15 receive and hold the reservoir 26 in place during use. Before installation into the base 14, the replaceable reservoir 26 may be pre-fitted with a pump 29 and nozzle 40, termed herein refill unit 27. Once installed, a manually activated push bar 39 (FIG. 1) may actuate the pump 29 by direct contact or contact through a series of linkages (not shown). Alternatively, the pump 29 may be connected to a motor 30 (shown in FIG. 2*a*) connected via couplings or linkages used to actuate the pump 29 and thereby dispense product. Actuation in this embodiment may be initiated by a sensor 110 configured to detect the presence of a user's hand in proximity to the nozzle 40 (reference FIG. 2). In such an embodiment, sensor 110 is in circuit communication with a processor (not shown) and the processor controls the on/off time of motor 30.

"Circuit communication" as used herein indicates a communicative relationship between devices. Direct electrical, electromagnetic and optical connections and indirect electrical, electromagnetic and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers or satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, such as, for example, a CPU, are in circuit communication. Circuit communication includes providing power to one or more devices. For example, a processor may be in circuit communication with one or more batteries, indicating that the batteries provide power to the processor.

Also, as used herein, voltages and values representing digitized voltages are considered to be equivalent for the purposes of this application, and thus the term "voltage" as used herein refers to either a signal, or a value in a processor representing a signal, or a value in a processor determined from a value representing a signal.

"Signal", as used herein includes, but is not limited to one or more electrical signals, power signals, analog or digital signals, one or more computer instructions, a bit or bit stream, or the like.

"Logic," synonymous with "circuit" as used herein includes, but is not limited to hardware, firmware, software and/or combinations of each to perform a function(s) or an action(s). For example, based on a desired application or needs, logic may include a software controlled microprocessor or microcontroller, discrete logic, such as an application specific integrated circuit (ASIC) or other programmed logic device. Logic may also be fully embodied as software. The circuits identified and described herein may have many different configurations to perform the desired functions.

The values identified in the detailed description are exemplary and they are determined as needed for a particular dispenser and/or refill design. Accordingly, the inventive concepts disclosed and claimed herein are not limited to the particular values or ranges of values used to describe the embodiments disclosed herein.

Figure 1A:
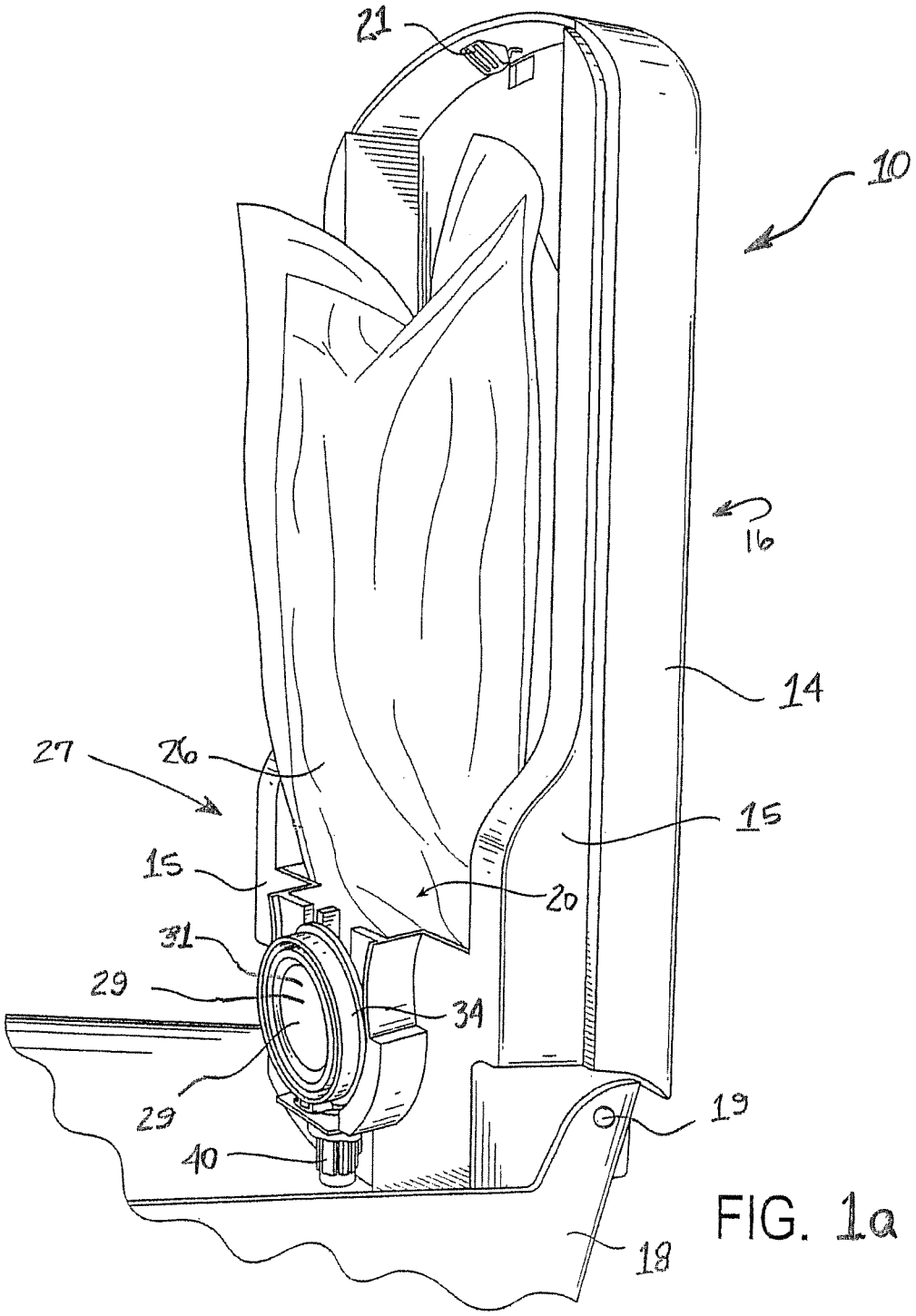
FIG. 1*a* depicts an exemplary embodiment of a manually activated product dispensing system showing an internal region of the product dispenser.

With continued reference to FIG. 1*a*, the product dispenser 10 may be equipped with one of various types of pumping mechanisms. In one instance, pump 29 may be a dome pump 29'. The dome pump 29' may include a rigid base 34 and flexible dome 31 that assemble to define a pump chamber having a predetermined volume. An inlet and outlet, not shown, are formed in the rigid base 34 which connect to an opening in the product reservoir 26 and the nozzle 40 respectively. Check valves, positioned in the fluid pathway near the inlet and outlet, ensure fluid flow from the reservoir 26 to the nozzle 40. Alternatively, pump 29 may be a piston pump 29", shown in the FIG. 5, where the pump 29" includes an inlet 36 and outlet 37 for dispensing product to the end user.

It is explicitly noted here that while the written description discusses a dispenser that is encased in a single enclosure and which may be mounted to a wall or dispenser stand, it is to be construed that applications of the subject invention also relate to hand held dispensers, counter mounted dispensers or other such types of dispensing devices.

Figure 5:
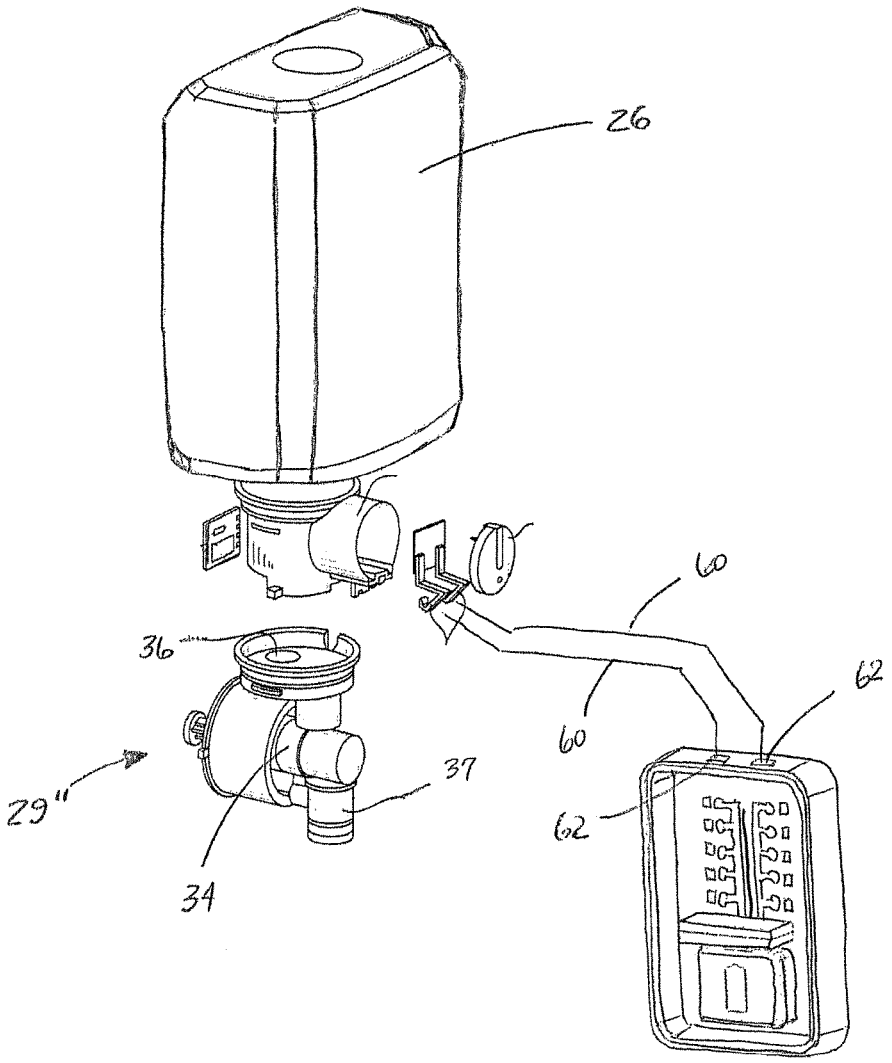
FIG. 5 depicts an exemplary embodiment of a source of power Incorporated into a product reservoir.

A source of power 50 may be incorporated into the product dispenser 10. The source of power 50 (FIG. 3), or power source 50, may be comprised of, either individually or in combination of, any of the following but not limited to: mains power, solar or photoelectric power, disposable or rechargeable batteries, power harvested from temperature differential or electro-magnetic waves. The embodiments described and illustrated herein discuss batteries 51 (reference FIG. 3), such as, for example, electrochemical cell batteries, which are exemplary in nature and should not be construed as limiting. In one particular embodiment, the product dispenser 10 includes an onboard source of power 50, wherein the batteries 51 may be received by the base 14, cover 18 or other product dispenser component. The batteries 51 may be removed when depleted of energy and replaced with new batteries. An alternate embodiment is contemplated where the batteries 51 need not be directly mounted to or received by the product dispenser 10, but rather may be received or installed into the replaceable reservoir 26 or refill unit 27 (FIG. 5). In this manner, when the reservoir 26 or refill unit 27 is replaced, the product dispenser 10 is concurrently resupplied with afresh power source 50, (batteries 51). Accordingly, energy from the batteries 51 may be used to operate the motor 30, provide power to a dispense control unit 90 (also known as a controller 90), enable operation of sensors 110 and/or supply power to one or more dispenser plug-in circuit modules 80 via backplane 58, as will be discussed in detail below.

Figure 4:
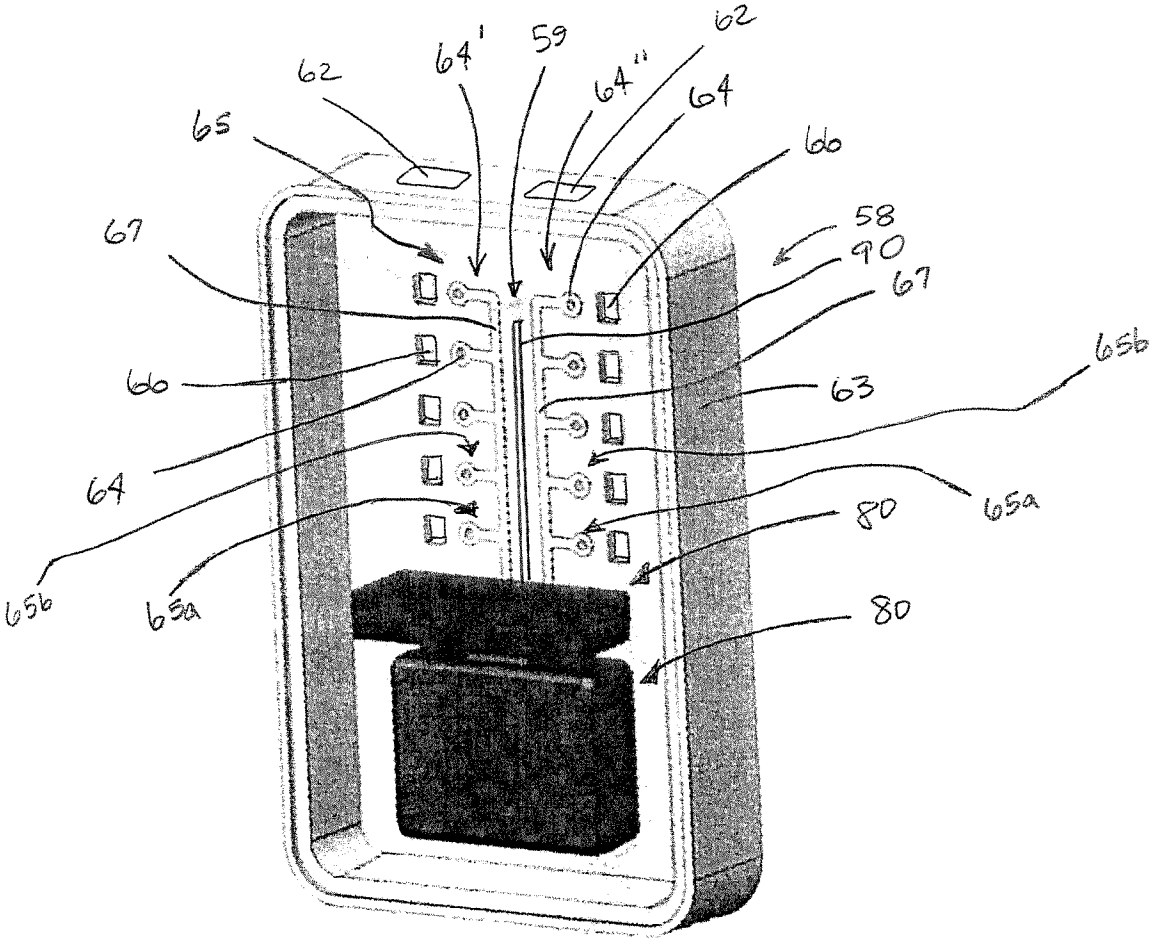
FIG. 4 depicts an exemplary embodiment of a backplane having multiple contact terminals.

With reference now to FIGS. 3 and 4, a backplane 58 is provided for installation into the product dispenser 10 and is used to supply power to multiple dispenser plug-in circuit modules 80, also referred to herein as plug-in circuit modules 80. In one embodiment, the backplane 58 may be affixed or installed in the base 14. Alternative embodiments are contemplated where the backplane 58 may be installed onto other components of the product dispenser 10 like for example the cover 18 or even the refill unit 27 itself. Still other embodiments contemplate a backplane 58 that is integrated into or integrally formed with the dispense control unit 70.

The backplane 58 may be constructed as a unitary article or assembly having a frame 63 separate from the walls 15 of the product dispenser 10. The backplane 58 may be installed into the product dispenser 10. Fasteners, adhesives or other means of securing the backplane 58 may be employed. It is not necessary that the backplane 58 be permanently mounted into the product dispenser 10, but may be readily removable. It follows that any manner of permanently or removably mounting the backplane 58 to the product dispenser 10 may be chosen with sound judgment. Alternatively the functional elements of the backplane 58 may be integrally formed with the walls 15, which is to say that the frame 63 of the backplane 58 is forms one or more of the walls 15 of the product dispenser 10.

Still referencing FIGS. 3 and 4, the backplane 58 includes a series of electrically conductive contact points 64, referred to herein as contact terminals 64, which may be electrically connected via electrically conductive pathways 67 made of copper or other suitable electrically conductive material. The series of contact terminals 64 may be divided into multiple sets 65 of first and second contact terminals 64', 64". The first contact terminal 64' of each set 65 may be electrically connected together and also electrically communicated to the first terminal of the source of power 50. Likewise, the second contact terminal 64" of each set 65 may be connected together and also to the second terminal of the source of power 50. Skilled artisans will appreciate that the first and second contact terminals 64', 64" may be positioned proximal to each other. For discussion purposes, adjacently positioned first and second contact terminals 64', 64" are referred to herein as a set of contact terminals 65. Each set 65*a* of contact terminals 64', 64" may be spaced apart from another set 65*b*. In this manner dispenser modules 80, having mating contact pins, may be selectively installed onto the backplane 58 for customizing the product dispenser 10 according to the embodiments described herein. A particular dispenser module 80 may be designed for electrical connection to a single set 65 of contact terminals, e.g. contact terminals 65*a*, although this need not necessarily be the case. It follows that when installed into the product dispenser 10, the backplane 58 is electrically connected to the source of power 50. Conductors 60 and/or contact members 62 (reference FIGS. 3 and 5) may be employed to communicate electrical power (and/or electrical data signals) to the backplane 58 in a manner known in the art. In some embodiments, a communication buss 90 is included in backplane 58. Communication buss 90 allows the modules 80 to communicate with one another through electrical data signals. When module 80 is inserted into dispenser 10, it receives powers through contacts 64' and 64", one of which may be a ground. In addition, if the module 80 needs to communicate with other dispenser modules 80', module 80 includes a connector 91 that connects into communication bus 90. In some embodiments each module 80 includes a processor and communication circuitry. In some embodiments, one module 80 (main module) includes a processor and the other modules are slave modules that utilize the processor in the main module. In some embodiments, the modules 80 do not include a communication buss connector and communicate wirelessly with the main module or other modules. In some embodiments, the modules operate autonomously.

It is noted here that the electrically conductive pathways 67 and contact terminals 64 are formed in, or applied to, a substrate 59 (reference FIG. 4). The substrate 59 may be the same as the material comprising the frame 63 of the backplane 58, or in an alternate embodiment may be the same as the material comprising the walls 15 of the product dispenser 10. As such, the structural material comprising the frame 63 or walls 15 may be constructed of material having low conductivity or material that functions as an electrical insulator. Alternatively it is contemplated that the substrate 59 may be separate from the structural material comprising the frame 63 or walls 15, wherein the substrate 59 comprises a separate layer of material applied to the frame 63 or walls 15.

With ongoing reference to FIG. 4, the backplane 58 may include connector receiving members 66, which functions to secure the dispenser modules 80 to the frame 63 of the backplane 58. The backplane 58 may include one or more connector receiving members 66 for each set 65 of contact members. The connector receiving member(s) 66 may be positioned close to its corresponding set 65 of contact members 64. The connector receiving members 66 may be configured to receive connectors 86 integrally formed into the dispenser module 80. Connectors 86 may include a release member (not shown) for removing the module 80 from dispenser 10 if it needs to be replaced or reconfigured. The particular configuration of connector receiving member 66 and connectors 86 should not be construed as limiting. However, in the illustrated embodiments the connector receiving member 66 comprises an aperture 66 formed in the frame 63 of the backplane 58. Correspondingly, connector 86 may comprise protruding members 86 that snap fit into the aperture 66 and latch in place thereby securing the dispenser module 80 to the backplane 58. Skilled artisans will understand that the connector receiving member 66 may, in an alternative embodiment protrude from the frame and the connectors 86 may be recessed into the dispenser modules. Other means may be employed to secure the dispenser module 80 to the backplane 63 which include selectively releasable fasteners or even permanently mounted adhesives.

Figure 6:
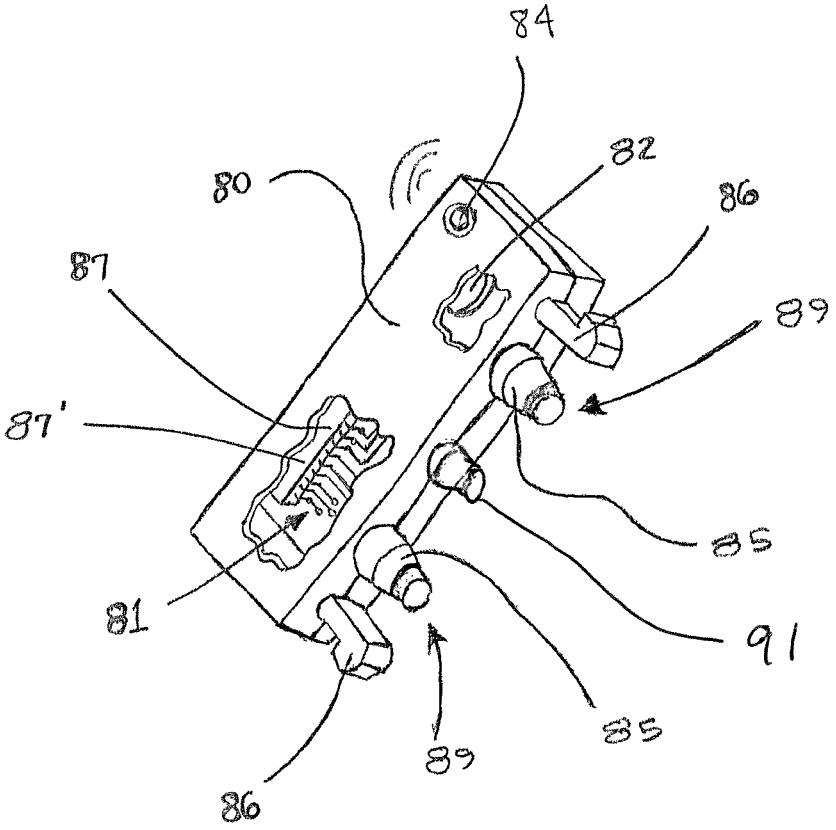
FIG. 6 shows an exemplary embodiment of a partial cutaway view of a plug-in circuit module.

FIG. 6 shows a dispenser module 80 according to the embodiments of the subject invention. The dispenser module 80 may include an electrical circuit 81 capable of processing information about the product dispenser 10. By processing information it is meant that the electrical circuit 81 may function to monitor, store and/or communicate information about dispenser activity or dispenser status. Accordingly, electrical circuit 81 may include one or more sensors 82 for monitoring the product dispenser 10. Different types of sensors 82 may be used in the dispenser module 80 including but not limited to: accelerometers, IR sensors, ultrasonic sensors, inductive/capacitive sensors, voice-activated sensors and the like. The sensors may function to detect a dispense event or the presence of a user in proximity to the product dispenser 10. The sensors may also function to measure the height of an end-user standing in front of the product dispenser 10 or the width of the end user's hand when the hand is positioned in proximity to the product dispenser 10. Still, other sensors may be used to detect the amount of product remaining in the reservoir 26 or the amount of charge remaining in the batteries 51. In some embodiments, module 80 includes a communication buss connector 91 for connecting to communication buss 90.

Moreover, the electrical circuit 81 may include transmitters, receivers or transceivers indicated by reference number 84. The transmitter-receivers 84 may be used to communicate information gathered from the product dispenser 10. In one embodiment, the electric circuit 81 via the transmitter-receivers 84 transmits data to a remote data-receiving host which may be a computer or other information processing device. Persons of skill in the art will understand that the mode of transmission may include short range data transmission means (e.g. bluetooth or IR) or other longer-range data transmission means, which may include RF signals. It is to be construed that the manner in which data is transmitted and/or received by the dispenser module 80 does not limit the scope of the claimed invention.

A logic processing unit 87, which may comprise a microprocessor 87', may be integrated into the dispenser module 80. Additional circuitry may include dynamic and or static memory storage connected to the logic processing unit in a manner well known in the art. It will be appreciated that the logic processing unit may be programmable and may include algorithms in the form of code stored within the circuitry 81.

Still other embodiment are contemplated where energy storage devices may be integrated into the dispenser module 80, like for example super-capacitors, button cell batteries or other types of energy storage devices.

With continued reference to FIG. 6, the dispenser modules 80 may be easily plugged into the backplane 58, as shown in FIG. 4. Contact pins 89 may protrude from an end or side of the dispenser module 84 for direct contact with a set 65 of contact terminals as described above. In one embodiment, dispenser module 80 may include two contact pins 89. However the dispenser module may include any number of contact pins as is appropriate for facilitating operation of a particular dispenser module 80. It will be appreciated that the contact pins may include electrically conductive material 85 which may be tapered or rounded for easy insertion onto the contact terminals 64 of the backplane 58. Stated differently, the contact pins 89 may be configured so that the dispenser module 80 may be easily plugged-in to the substrate of the backplane 58.

With reference again to FIG. 3, the dispenser control unit 90 may comprise one or more electronic circuits 91 for controlling operation of the product dispenser 10. The electronic circuitry 91 may reside on a printed circuit board 94 and may be housed in the product dispenser 10, i.e. supported by the walls 15, or may reside in one or more modules. The dispenser control unit 90 may be connected to the batteries 51 for providing operating power to the electronic circuits 91. In some embodiments, dispenser controller unit 90 may be a module 80, referred to herein as the main module. In some embodiments the features described above with respect to the main module are in the dispenser controller 90. In some embodiments, one or more of the modules 80 are in circuit communications with dispenser controller 90 and communicate one or more data signals.

The electronic circuits 91 (and those in the one or more modules 80) may comprise digital electronic circuitry 92 designed to receive and process data relating to operation of the product dispenser 10. In particular, the digital electronic circuitry 92 may functions to generate output signals that activate the motor, receive input signals from one or more sensors 110 and/or may be electrically connected to the backplane 58 for communicating with one or more of the dispenser modules 80. In one embodiment, the digital electronic circuitry 92 includes a logic processor 93, which may be a programmable logic processor capable of executing coded instructions. The electronic circuitry 92 may further include non-volatile data storage and/or volatile memory as may be used for any of the product dispenser operations In one particular embodiment, sensors 110 may be incorporated into the product dispenser 10 (reference FIG. 2). These sensors 110 are used to detect motion for hands-free activation of the product dispenser 10. The sensors 110 may comprise one or more IR emitters and detectors. The emitter-detector pairs may be oriented in a manner that ensures consistent activation within a particular region under the nozzle 16. It follows that the dispenser control unit 90 functions to receive input from the sensors 110 and is capable of initiating a dispense event in response to the sensor output.

As described above, the backplane 58 includes multiple plug-in slots for receiving one or more dispenser modules 80 (or circuit modules 80) as may be required use in one of any number of different applications. The dispenser modules 10 may be customized for use in different applications by changing the type and/or quantity of dispenser modules 80 that are installed. Some dispenser modules 80 may only function when used in conjunction with and when electrically communicating with the dispenser control unit 90, while other dispenser modules 80 may operate independently of the dispenser control unit 90. Notably, multiple dispenser modules 80 installed into the backplane may differ from one another, each comprising different circuitry that performs substantially different functions. However, in some applications, a product dispenser 10 may be configured to use multiple dispenser modules 80 all performing the same or similar functions.

Product dispensers 10 may be customized by installing the base components necessary and common to all product dispensers 10 and then selectively installing those dispenser modules 80 as may be needed for a particular application. For example, it may be important in a particular market that the dose of product dispensed onto a user's hands be properly measured according to the size of the person. Accordingly, a dispenser module 80*a* that incorporates sensors and circuitry for measuring hand size may be installed into the product dispenser by plugging in the dispenser module 80*a* into the backplane 58. It will be appreciated that not every product dispenser need include this particular function as it adds cost to the production of the dispenser 10. In another application, it may be desired or necessary to track or transmit data about the person using the product dispenser 10. As such, a dispenser module 80*b* that reads information from an identification badge may be installed into the backplane 58. Some modules may simply store the data while other modules may employ a transmitter for wireless communication of the data to a remote location.

In manufacturing, a portion of all of the product dispensers 10 may be assembled in the same manner using the same types of components. At some point in the manufacturing process, certain product dispensers 10 may be customized by plugging in dispenser modules 80 that have operating features suited for the intended application of that dispenser 10. It will be appreciated by those skilled in the art, that the product dispensers 10 may be customized either during the manufacturing process or at some point after manufacturing, like for example during the installation of the product dispenser 10. During assembly, a first product dispenser may be assembled with a first backplane. Depending on the end use for that product dispenser, a particular set of dispenser modules may be plugged into the first backplane whereafter the product dispenser is shipped to its installation site. A second product dispenser may similarly be assembled with a second backplane and a different set of dispenser modules may be plugged into the second backplane for use in a different location.

Figure 7:
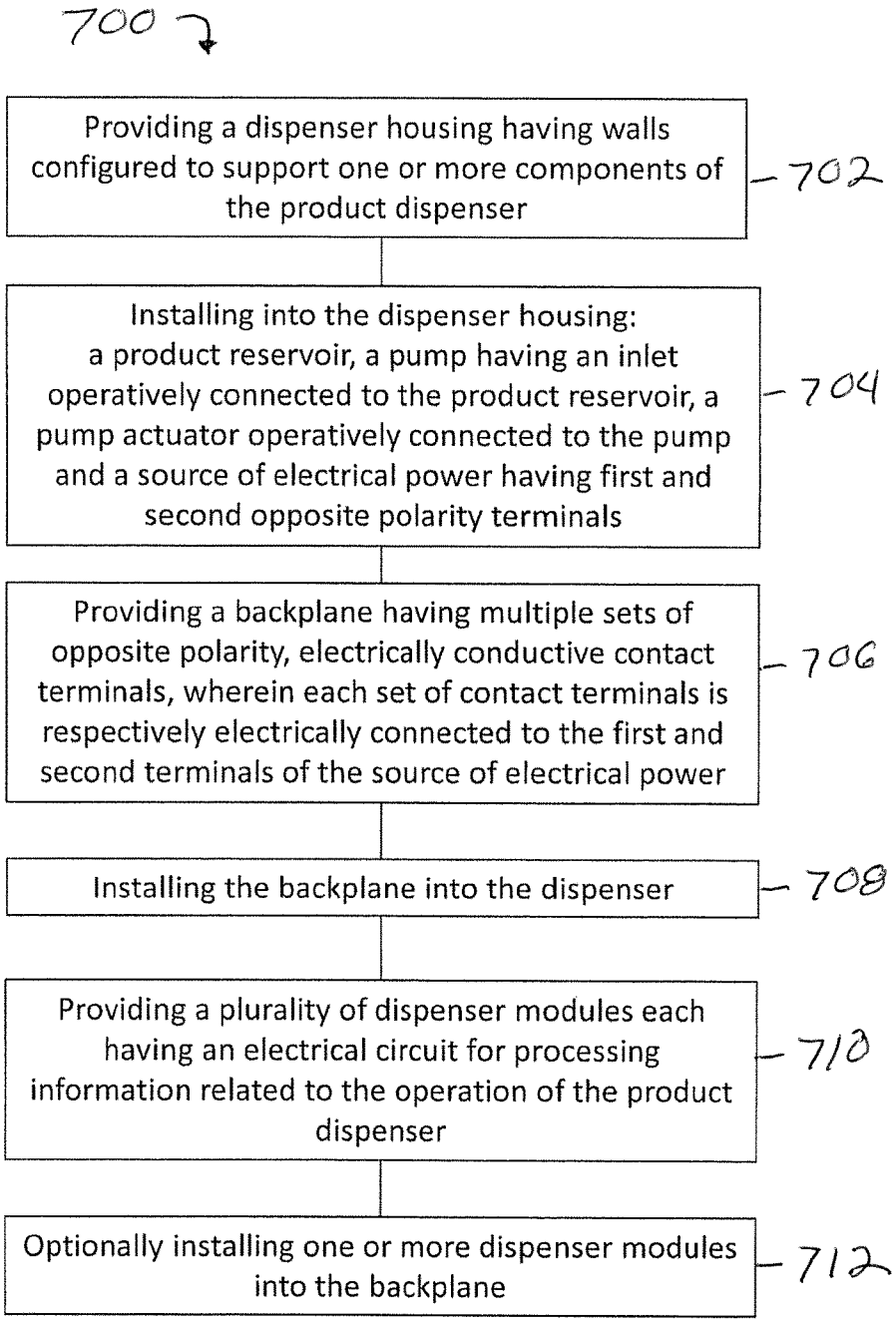
FIG. 7 shows an exemplary embodiment of a method of customizing a product dispenser.

FIG. 7 illustrates an exemplary methodology 700 for custom assembly of a product dispenser. The exemplary methodology includes providing a dispenser housing having walls configured to support one or more components of the product dispenser at block 702. At block 704 a product reservoir; a pump having an inlet operatively connected to the product reservoir; a pump actuator operatively connected to the pump and a source of electrical power having first and second opposite polarity terminals are installed in the dispenser. At block 706 a backplane having multiple sets of opposite polarity electrically conductive contact terminals, wherein each set of contact terminals is respectively electrically connected to the first and second terminals of the source of electrical power are provided. At block 708 the backplane is installed into the dispenser. At block 710 one or more dispenser modules each having an electrical circuit for processing information related to the operation of the product dispenser are provided; and at block 712, the one or more dispenser modules are installed into the backplane.

Having illustrated and described the principles of the dispensing system in one or more embodiments, it should be readily apparent to those skilled in the art that the invention can be modified in arrangement and detail without departing from such principles.

It is claimed:

1. A product dispenser, comprising:

a housing configured to support one or more components of the product dispenser;

a receptacle for receiving a replaceable product reservoir that includes a pump;

a pump actuator that operatively couples to the pump, when the replaceable product reservoir is installed in the dispenser;

a source of electrical power; and a backplane electrically connected to the source of electrical power for providing electrical power to more than one plug-in circuit modules, the backplane having:

multiple sets of electrically conductive contact terminals, where each set of contact terminals is operable to electrically connect to a plug-in circuit module when a plug-in circuit module is inserted into the backplane, and multiple connector receiving members each juxtaposed to a corresponding set of contact terminals, wherein each connector receiving member is adapted to hold a plug-in circuit module in place thereby securing the plug-in circuit module to the backplane.

2. The product dispenser as defined in claim 1, wherein the source of electrical power comprises one or more batteries mounted to the replaceable product reservoir, the replaceable product reservoir having electrical contact members for electrically connecting to the backplane.

3. The product dispenser as defined in claim 1, wherein the source of electrical power comprises one or more batteries received by the housing of the product dispenser.

4. The product dispenser as defined in claim 1, wherein the backplane is comprised of:

a substrate;

electrical conductors received within the substrate; and, wherein the substrate is affixed to the housing of the product dispenser.

5. The product dispenser as defined in claim 1, wherein the backplane comprises electrical conductors integrally formed into the housing of the product dispenser.

6. The product dispenser as defined in claim 1, further comprising a dispenser control unit controlling an operation of the product dispenser, wherein the dispenser control unit is powered by the source of electrical power.

7. The product dispenser as defined in claim 6, wherein the dispenser control unit is in a module.

8. The product dispenser as defined in claim 1, wherein the backplane includes a communication bus.

9. The product dispenser as defined in claim 1, further comprising:

a sensor capable of detecting the presence of a user's hand for activating the product dispenser, the sensor having an output signal operatively communicated with a dispenser control unit; and, wherein the pump actuator is motor powered by the source of electrical power and activated by the dispenser control unit.

10. The product dispenser as defined in claim 1, further comprising two or more plug-in circuit modules that include an electrical circuit for processing information about the dispenser, and wherein the two or more plug-in circuit modules include one or more electrical contacts arranged for electrical connection to one of the multiple sets of contact terminals to provide power to the two or more plug-in circuit modules from the backplane.

11. The product dispenser as defined in claim 10, wherein the contacts are contact pins protruding outwardly from a side of the plug-in circuit module, and wherein the plug-in circuit module, includes a connector protruding outwardly from the side of the plug-in circuit module, the connector being aligned with the contact pins for attaching to a connector receiving member of the backplane.

12. A method of customizing assembly of a product dispenser, comprising the steps of:

providing a dispenser housing having walls configured to support one or more components of the product dispenser;

providing a source of electrical power;

providing a backplane having multiple sets of electrically conductive contact terminals, wherein each set of contact terminals is respectively electrically connected to a first and second terminals of the source of electrical power;

installing the backplane into the dispenser;

providing two or more dispenser modules each having an electrical circuit for processing information related to the operation of the product dispenser.

13. The method as defined in claim 12, further comprising:

installing a first module in the dispenser thereby electrically connecting the first module to one or more of the sets of contact terminals.

14. The method as defined in claim 13, further comprising:

installing a second module on the back plane.

15. The method as defined in claim 12, wherein the backplane includes a communication buss.

16. A product dispenser, comprising:

a housing;

a pump actuator;

a source of electrical power;

a power buss for receiving a plurality of separate plug-in modules;

wherein the power buss has a plurality of contacts, wherein a first portion of the contacts are in circuit communication with the electrical power supply providing a first voltage to the first portion of the contacts;

wherein a second portion of the contacts are in circuit communication with the electrical power supply providing a second voltage to the second portion of the contacts;

the second voltage being less than the first voltage;

a first plug-in module connected to the power buss;

wherein the first plug-in module receives power from the power buss when plugged into the dispenser and does not receive power from the power buss when it is not plugged into the dispenser; and a second plug-in module connected to the power buss;

wherein the second plug-in module receives power from the power buss when plugged into the dispenser and does not receive power from the power buss when it is not plugged into the dispenser.

17. The product dispenser as defined in claim 16, wherein one of the plug-in modules includes a sensor for detecting the proximity of a user's hand in relation to the product dispenser; and, wherein another of the plurality of plug-in modules includes a transmitter for wirelessly communicating information about the product dispenser to an associated wireless receiver.

18. The product dispenser as defined in claim 16, further comprising a communication buss.

19. The product dispenser as defined in claim 18, wherein at least one of the modules comprises a communication circuit connector for connecting to the communication buss.

20. The product dispenser as defined in claim 16, wherein the power buss is removable from the dispenser.

* * * * *